US006075756A

United States Patent [19]

Coleman et al.

[11] Patent Number: 6,075,756

[45] Date of Patent: Jun. 13, 2000

[54] TIME POP

[76] Inventors: Thomas J. Coleman, 19170 Paddock Pl., Abingdon, Va. 24211; William K. Schlotter, IV, 117 Wateredge La., Fredericksburg, Va. 22406; Princess Ann Coleman, 19170 Paddock Pl., Abingdon, Va. 24211; Ann M. Schlotter, 117 Wateredge La., Fredericksburg, Va. 22406

[21] Appl. No.: 09/154,210

[22] Filed: Sep. 16, 1998

[51] Int. Cl.[7] ..... G04B 47/00; G04B 37/00

[52] U.S. Cl. ..... 368/10; 368/278

[58] Field of Search ..... 368/10, 88, 276, 368/278

[56] References Cited

U.S. PATENT DOCUMENTS

| | | | |
|---|---|---|---|
| 1,146,351 | 7/1915 | Schlesinger | 368/278 |
| 1,816,779 | 7/1931 | Jeasneret | 368/278 |
| 2,745,244 | 5/1956 | Friedli | 368/278 |
| 4,086,756 | 5/1978 | Drake | 368/282 |

*Primary Examiner*—Vit Miska
*Attorney, Agent, or Firm*—Melvin L. Crane Agent

[57] ABSTRACT

A novelty candy holding device which is in combination with a stop watch and a beeper. The stop watch can be activated and deactivated by a start/stop button/switch, when the stop watch is stopped, the start/stop button/switch activates a circuitry to a beeper and the beeper beeps until the reset button of the stop watch is pressed to reset the digital display to zeros and at the same time to inactivate the beeper.

14 Claims, 2 Drawing Sheets

TIME POP

This invention is directed to a time pop and more particularly to a pop secured on a stop watch or any other type of watch which is activated in order to determine an amount of time required to consume the pop, or for any other purpose.

BACKGROUND OF THE INVENTION

Variously devices have been patented by applicants by which a candy pop can be held by the device and consumed by the user. Applicants do not know of any prior art devices which secure a lollipop in place and is provided in combination with a stop watch by which the consumer can time themselves or some other person to see how much time is used to consume the lollipop.

The following patents are directed to a watch: U.S. Pat. Nos. 3,691,757; 4,266,288; 4,482,256; 4,769,797; and 5,063,544.

OBJECTS AND ADVANTAGES

It is therefore an object of the invention to combine a stop watch with a lollipop so that one can measure the time used in consuming the lollipop or it may be used to time someone else's consumption time.

It is still another object of the invention to provide a beeper which makes a beeping sound at such time that one presses the stop button to inactivate the stop watch.

SUMMARY OF THE INVENTION

The invention is directed to a stop watch which is activated by pressing a start/stop button and which continues to operate until the start/stop button is again pressed. The stop watch functions as a regular stop watch to enable a person to determine a time for a certain event such as time in consuming the lollipop, time of a game, or any sports event which one desires to time. Upon consuming the lollipop, another such lollipop can replace the consumed lollipop.

Other objects and benefits of the invention can be determined by reference to the disclosure and drawings.

DETAILED DESCRIPTION

Figure 1:
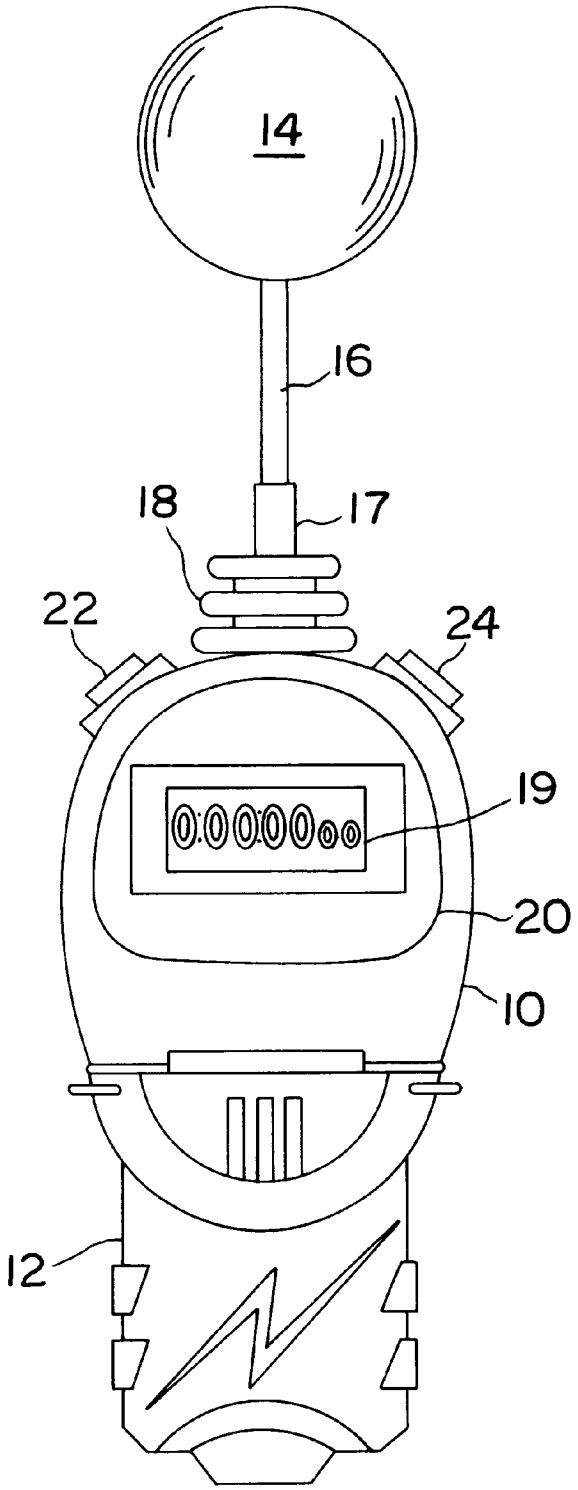
FIG. 1 represents a front side of a normal digital stop watch with start/stop controls and a zero setting button.

Now referring to the drawings wherein the same reference characters represent the same elements throughout the drawing, there is shown in FIG. 1 a front face or front side of a regularly operated stop watch. The stop watch includes a casing or main housing 10 which can be plain or decorative for amusement by children. The housing is provided with a handle 12 extending from the casing which permits one to easily hold the stop watch during use in consuming a candy lollipop 14 which is secured to the end opposite from the handle by use of a lollipop stick 16 the stick may be of wood or rolled paper which in general terms is referred to as a "stick". The stick is inserted into an aperture 17 and held in place by a candy stick anchor 18 which secures the stick therein by a tight fit. The face has a digital display window 19 covered by a lens 20. As seen from the front face, there is provided a zero return button 22 which is provided to reset the digital display back to all zeros, once the stop watch has been used and stopped. A start/stop button 24 is provided on a side opposite from the reset button and is used to activate the stop watch and to stop the operation when desired. The amount of lapsed time will be shown by the digital display. Once the value of the digital display has been read, the reset or zero button can be pushed to reset the digital display back to zeros.

Figure 2:
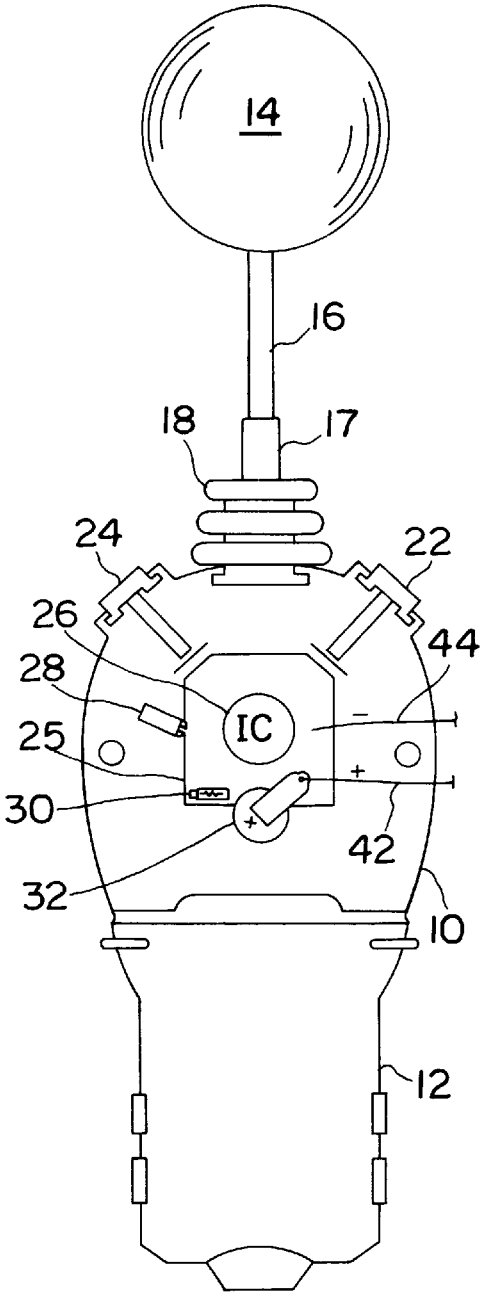
FIG. 2 illustrates the circuitry and operative parts of the stop watch.

FIG. 2 illustrates the various operative parts set forth previously as well as a circuit board 26 including a NE558 integrated circuit 26, a S4X3 capacitor 28, a variable resistor 30 which can adjust the accuracy and a power supply 32 for supplying the power to the IC and to a beeper.

Figure 3:
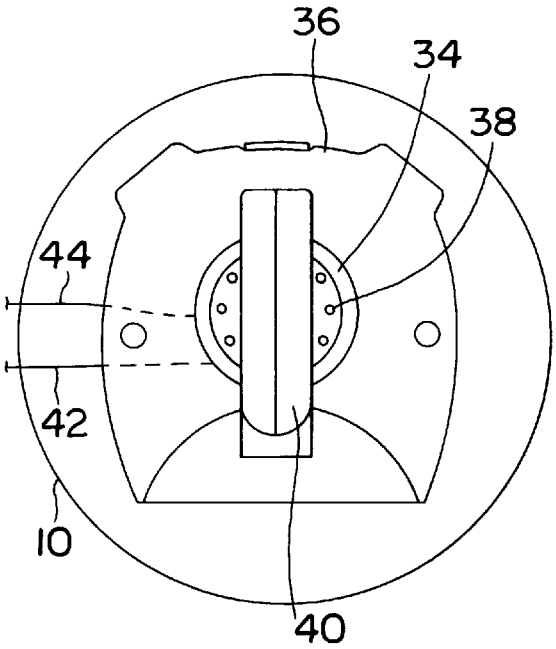
FIG. 3 illustrates a back side of the watch which has a clip for securing the watch on a belt and also illustrates a beeper speaker.

FIG. 3 illustrates a cover 36 for the watch. In addition to serving as a cover, the cover is provided with a beeper speaker 38 and a spring clip 40 which is used to secure the watch to a belt or some other part of one's clothing. FIGS. 2 and 3 illustrates a positive electrical wire 42 and a negative electrical wire 44 which connect the power supply to the beeper.

The time pop provides a new toy for holding a lollipop while one consumes the lollipop. The stop watch can be used for timing any timed sequence of an event. One such example is the time that it takes a person to consume the lollipop. Anther use could be to see how much longer one person uses to consume a lollipop than another person uses. The stop watch can be used for sporting events such as a foot race, bicycle race, or any other use.

In operation the stop watch is activated by pressing the start/stop button. The watch will then operate until the start/stop button is pushed again, which will stop the watch. One can then observe the lapsed time by viewing the digital dial which will indicate the lapsed time in seconds, tenths of seconds, or hundreds of seconds, depending on the accuracy of the integrated circuitry. When the start/stop switch is pressed, power is delivered to the variable resistor, the capacitor and IC circuit to activate the digital display. When the timed sequence has ended, the start/stop button is pressed to inactivate the circuitry to the digital display. Upon inactivation of the timed sequence, the circuitry to the beeper is activated and the beeper will beep until the zero reset button is pushed in order to reset the digital display to all zeros and to inactivate the beeper.

When the time pop is not in use, it can be secured to one's belt or to some other piece of clothing by use of a clip or other securing means which will secure the time pop in place- When in use to consume the time pop, the watch would be held by the handle. Once the candy pop has been consumed, the candy stick can be removed from the candy stick anchor and replaced by another lollipop on a stick.

It would be obvious that a time pop could be made with the candy pop adhered to the aperture and stick anchor and then upon consumption of the initial candy pop, a candy pop on a stick could replace the original candy pop. Whether the candy pop is secured to the aperture and anchor or to a stick will not affect the operation of the stop watch. In this way, one can have a stop watch without an extended candy stick and then after consuming the original candy pop, the original candy pop can be replaced by a candy pop on a stick. By replacing the original candy pop, the time pop can be used over and over.

The foregoing relates to preferred exemplary embodiments of the invention, it being understood that other variants and embodiments thereof are possible within the spirit and scope of the invention, the latter being defined by the appended claims.

We claim:

1. A time pop which comprises a watch which indicates a lapse of a time period, a candy lollipop secured to one end of said watch.

2. A time pop as set forth in claim 1, in which said watch includes a handle on one end for holding said watch in place.

3. A time pop as set forth in claim 2, in which said watch includes a candy stick anchor to which a lollipop is secured.

4. A time pop as set forth in claim 1, in which said watch is a stop watch, said stop watch includes a start/stop button and a reset button.

5. A time pop as set forth in claim 2, in which said watch is a stop watch, said stop watch includes a start/stop button and a reset button.

6. A time pop as set forth in claim 3, in which said watch is a stop watch, said stop watch includes a start/stop button and a reset button.

7. A time pop as set forth in claim 3, in which said candy stick anchor includes an aperture for securing one end of a candy lollipop stick.

8. A time pop as set forth in claim 4, which comprises a switch means for activating a power supply to a beeper, and a switch means for inactivating power to said beeper.

9. A time pop as set forth in claim 5, which comprises a switch means for activating a power supply to a beeper, and a switch means for inactivating power to said beeper.

10. A time pop as set forth in claim 6, which comprises a switch means for activating a power supply to a beeper, and a switch means for inactivating power to said beeper.

11. A time pop as set forth in claim 1, in which said watch has a clip secured thereto for securing said watch to a support means.

12. A time pop as set forth in claim 2, in which said watch has a clip secured thereto for securing said watch to a support means.

13. A time pop as set forth in claim 3, in which said watch has a clip secured thereto for securing said watch to a support means.

14. A time pop as set forth in claim 4, in which said watch has a clip secured thereto for securing said watch to a support means.

* * * * *